US006779240B2

(12) United States Patent
Kluck et al.

(10) Patent No.: US 6,779,240 B2
(45) Date of Patent: Aug. 24, 2004

(54) GOLF SHAFT ALTERATION TECHNIQUE

(76) Inventors: Matthew J. Kluck, 1000 Pine Ave., Pittsburgh, PA (US) 15234; Christopher M. Allen, 4142 Bigelow Blvd., Pittsburgh, PA (US) 15213

( * ) Notice: Subject to any disclaimer, the term of this patent is extended or adjusted under 35 U.S.C. 154(b) by 25 days.

(21) Appl. No.: 10/127,789

(22) Filed: Apr. 22, 2002

(65) Prior Publication Data

US 2002/0173372 A1 Nov. 21, 2002

Related U.S. Application Data

(60) Provisional application No. 60/288,127, filed on May 2, 2001.

(51) Int. Cl.[7] ..... G01M 19/00

(52) U.S. Cl. ..... 29/407.08; 29/407.05; 29/557; 29/558; 29/401.1; 473/289; 473/409

(58) Field of Search ..... 29/401.1, 402.06, 29/407.05, 407.08, 557, 558; 473/409, 289

(56) References Cited

U.S. PATENT DOCUMENTS

| | | | | | |
|---|---|---|---|---|---|
| 4,122,593 | A | * | 10/1978 | Braly | 29/407.07 |
| 4,189,144 | A | * | 2/1980 | Guzzle et al. | 473/409 |
| 4,205,845 | A | * | 6/1980 | Kanne | 473/323 |
| 4,563,007 | A | * | 1/1986 | Bayliss et al. | 473/409 |
| 4,869,304 | A | * | 9/1989 | Gore | 144/354 |
| 4,900,025 | A | * | 2/1990 | Suganuma | 473/289 |
| 5,152,527 | A | * | 10/1992 | Mather et al. | 473/291 |
| 5,294,118 | A | | 3/1994 | Iwanaga | |
| 5,390,921 | A | | 2/1995 | De Ruyter | |
| 5,460,378 | A | * | 10/1995 | Getts | 473/251 |
| 5,465,967 | A | * | 11/1995 | Boeckenhaupt | 473/297 |
| 5,478,073 | A | * | 12/1995 | Hackman | 473/289 |
| 5,685,781 | A | | 11/1997 | Pedersen et al. | |
| 5,735,752 | A | | 4/1998 | Antonious | |
| 5,755,826 | A | * | 5/1998 | Beach et al. | 473/316 |
| 5,842,930 | A | * | 12/1998 | Koterba | 473/204 |
| 5,931,744 | A | * | 8/1999 | Hackman | 473/319 |
| 5,944,616 | A | * | 8/1999 | Horwood et al. | 473/289 |
| 6,042,357 | A | * | 3/2000 | Adams | 425/140 |
| 6,197,615 | B1 | | 3/2001 | Song et al. | |
| 6,213,888 | B1 | * | 4/2001 | Kawaguchi et al. | 473/223 |
| 6,405,595 | B1 | * | 6/2002 | Harrison | 73/573 |
| 6,511,386 | B1 | * | 1/2003 | Cacicedo | 473/300 |
| 6,532,818 | B2 | * | 3/2003 | Blankenship | 73/579 |
| 6,558,278 | B2 | * | 5/2003 | Bunn et al. | 473/409 |
| 2003/0083146 | A1 | * | 5/2003 | Shimizu et al. | 473/318 |

FOREIGN PATENT DOCUMENTS

| | | |
|---|---|---|
| JP | 5-43720 | 2/1993 |

* cited by examiner

*Primary Examiner*—Essama Omgba
(74) *Attorney, Agent, or Firm*—Paul A. Beck & Associates, P.C.

(57) ABSTRACT

A method for altering a golf club shaft by removing less than five grams of metal from an interior wall surface in a flex zone. This is performed without penetrating through an exterior wall surface of the shaft.

4 Claims, 2 Drawing Sheets

GOLF SHAFT ALTERATION TECHNIQUE

CROSS REFERENCE TO RELATED APPLICATION

Figure 1:
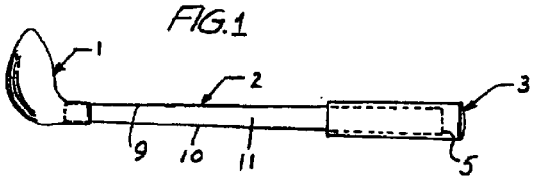

Applicant is claiming the benefit of the prior filed Provisional Application No. 60/288,127 filed on May 2, 2001.

BACKGROUND OF THE INENTION

1. Field of the Invention

This invention involves the alteration of an existing golf club shaft.

2. Description of the Problem and Related Art

A golf shaft can be improved by increasing feedback (which is also referred to as feel) that the shaft gives the golfer when the club strikes a ball while maintaining the original flexure of the golf shaft. A golf shaft with technical properties to properly fit a golfer, i.e. shaft flex (or amount of stiffness) makes it difficult for the golfer to get necessary club to ball feedback without sacrificing the shaft properties that influence the ball flight characteristics.

For example, to achieve good feel by the golfer the shaft is made too flexible for the golfer's swing requirements. Feel, which is the feeling of club to ball contact, is given up by the golfer by keeping properly fitted flex properties of the golf shaft. The thickness of the shaft reduces vibration (which enhances feel of the club to ball contact) to the point where the golfer uses ill-fitted golf clubs to produce the feel desired, thus sacrificing ball flight and the desired swing principles. For example, the golfer who generates substantial club head speed must sacrifice performance of the club for feel at impact with a ball. The reason is the golf shaft wall thickness required to match a swing speed of a golfer must increase to match the swing characteristics of the golfer. Increasing the wall thickness of the shaft will stiffen the shaft flex and as a result reduce the feel transferred to the golfer's hands at impact. The feel is important because it gives the golfer the satisfaction of a well struck golf shot. This is important because the golfer will attempt to reproduce that same feel to try to consistently strike a golf ball the same and reproduce that same good golf shot. This is a golfer's ultimate feedback.

The problem becomes one of giving a golfer the correct shaft flex while at the same time providing the desired feel for feedback.

We have no knowledge of any attempted solution to this problem by anyone. Our invention is directed to a solution to the problem.

SUMMARY OF THE INVENTION

In an effort to create a softer feedback (feel) from the golf shaft we established a golf shaft alteration technique that effectively delivers this feel without compromising the performance or integrity of the shaft. This technique will enable a golf professional to properly fit a golfer with the proper shaft flex without sacrificing feel and as a result, without sacrificing performance.

We provide a method for altering a golf club shaft by providing a metal golf club shaft having a hollow interior with an interior wall surface, an exterior wall surface, a butt end, a tip end and a flex zone sixteen inches from the butt with a range one inch up and one inch down from the measured sixteen inch point. We remove less than five grams of metal from the interior wall surface in the flex zone without penetrating through the exterior wall surface. We preferably remove metal by a cutting bit inserted into the hollow interior shaft and removing metal shavings from the interior wall surface. The cutting bit is between one half inches and three quarter inches diameter. We continuously monitor the weight of metal being removed by either weighing the metal shavings being removed or by removing the metal and weighing the shaft.

A one-half to three-quarter inch placement drill bit is inserted into the golf shaft at the butt end and lowered into the shaft to the flex zone (sixteen inches from the butt of the club with a range of one inch up and one inch down from the measured sixteen inch point). The drill bit is used to drill out up to five grams of shaft weight to improve the feel and maintain the integrity (flexure properties) of the golf shaft.

This invention is intended to alter the present golf shaft while maintaining the essential properties of flex and durability of the golf shaft.

A BRIEF DESCRIPTION OF THE DRAWINGS

Figure 2:
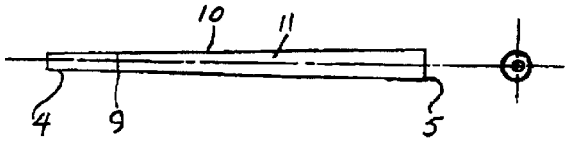
Figure 3:
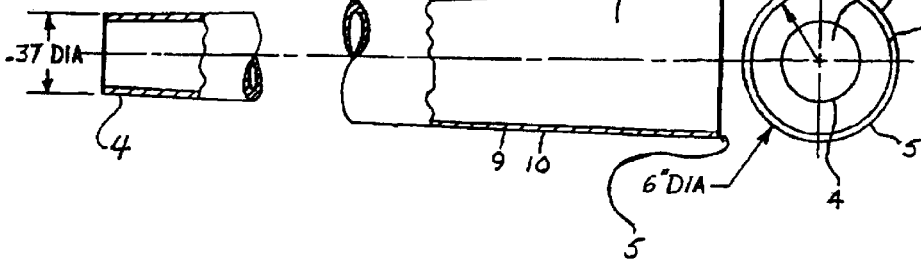
Figure 3A:
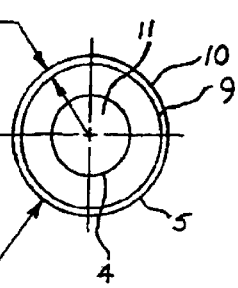
Figure 4:
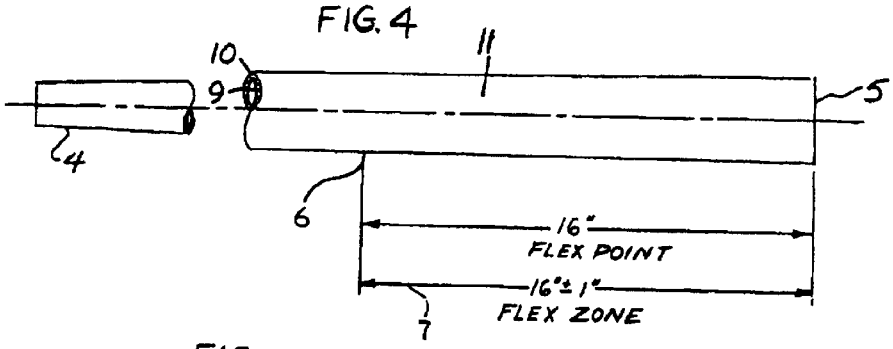
Figure 5:
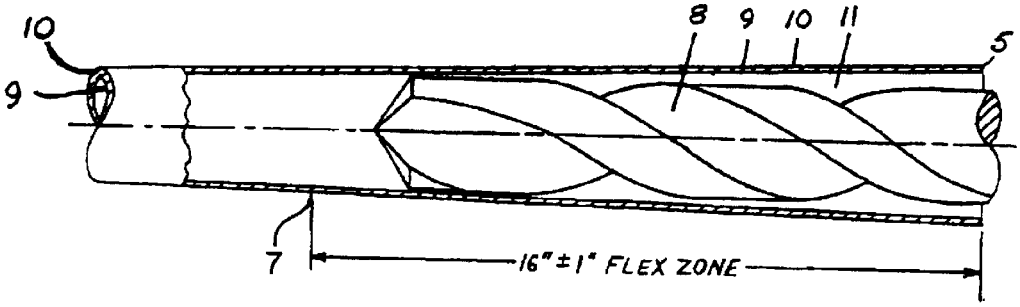

FIG. 1 A side elevation view of a golf club and includes the grip, shaft and club head;

FIG. 2 A side elevation view of a golf shaft;

FIG. 3 A partial side elevation view in section of a golf club shaft;

FIG. 3*a* An end view of the golf club shaft in FIG. 3;

FIG. 4 A partial side elevation view of a golf club shaft showing flex point and flex zone; and FIG. 5 Shows the shaft drilling technique with a drill bit inserted into a golf shaft shown in section in side elevation.

DETAILED DESCRIPTION OF A PREFERRED EMBODIMENTS

Definitions

"club shaft" means a long and usually cylindrical bar especially if rotating and transmitting motive power.

"hollow interior" means space surrounded by an interior wall.

"flex point" means a point on the club shaft sixteen inches from the butt end.

"flex zone" means a two inch range at a sixteen inch measurement point from the butt end of the club. This is a major factor in the feel of the golf club. This two inch range measures 15 inches to 17 inches from the butt end of the club. This is one inch either side of the 16 inch flex point.

"cutting bit" means a placement drill or a four point cutting drill bit.

"metal shaving" means metal sandings. "monitoring the weight" means drill and weigh as many times to achieve the desired weight reduction.

"butt end" means the end of the club which is usually the thickest in diameter and the grip is put over this section of the club; the handle.

"tip end" means the end of the shaft that is usually the smallest in diameter and has the club head attached to it.

"interior wall surface" means the interior perimeter of the hollow golf club shaft.

"exterior wall surface" means the exterior perimeter of the golf club shaft.

Description

Preferred embodiment of the invention will be described as a procedure with reference to the figures.

FIG. 1 shows a golf club having a golf club shaft 2 with a club head 1 and a grip 3.

FIGS. 2–3 show a metal golf club shaft 2 having a hollow interior 11 with an interior wall surface 9, an exterior wall surface 10, a butt end 5, and a tip end 4. FIGS. 4–5 show a flex zone 7 sixteen inches from the butt end 5 with a range one inch up and one inch down measured from a measured sixteen inch flex point 6. Stated another way the range of the flex zone 7 is measured between 15 inches and 17 inches from the butt end 5.

Referring to FIG. 4, after the flex zone 7 is identified, one removes up to a maximum of five grams of weight of metal from the interior wall surface 9 (a procedure similar to milling the shaft) in the flex zone 7 without penetrating the interior wall surface 10.

FIG. 5 shows the removal of metal performed by inserting a cutting bit 8 that is between ½ and ¾ inches in diameter into the hollow interior 11 of the golf club shaft 2 and removing metal shavings (not shown) from the interior wall surface 9.

The weight of the metal being removed must be continually monitored by weighing the metal shavings or by removing the metal and weighing the golf club shaft 2.

The feel of the golf club shown in FIG. 1 is improved by removing metal shavings (milling) from the interior wall surface 9 of the golf club shaft 2 by inserting a cutting bit 8 ½ to ¾ of an inch in diameter into the flex zone 7. The removal of the shavings increases the feedback of the club to ball contact of the player.

Various changes could be made in the above construction and method without departing from the scope of the invention as defined in the claims below. It is intended that all matter contained in the above description as shown in the accompanying drawings shall be interpreted as illustrative and not as a limitation.

We claim:

1. A method for altering a golf club shaft to provide softer feedback to a golfer without changing properties of flex comprising:

(a) providing a metal golf club shaft having original flexure properties, a hollow interior with an interior wall surface, an exterior wall surface, a butt end, a tip end, a flex point and a flex zone wherein the flex point is located sixteen inches from the butt end, and the flex zone extends from 15 inches to 17 inches when measured from the butt end and includes the flex point with a range one inch up and one inch down from the measured sixteen inches point; and (b) removing less than five grams of metal from the interior wall surface in the flex zone without penetrating through the exterior wall surface so that the original flexure properties of the golf club shaft are substantially maintained.

2. The method as recited in claim 1 wherein the step of removal of metal is performed by a cutting bit inserted into the hollow interior shaft and removing metal shavings from the interior wall surface.

3. The method as recited in claim 2 wherein the cutting bit is between one half inches and three quarter inches diameter.

4. The method as recited in claim 2 including continuously monitoring the weight of metal being removed by either weighing the metal shavings being removed or by removing the metal and weighing the shaft.

* * * * *